United States Patent [19]

Carrier

[11] Patent Number: 5,076,151

[45] Date of Patent: Dec. 31, 1991

[54] BURIAL MONUMENT VAULT AIR CIRCULATION AND FILTRATION SYSTEM

[76] Inventor: Johnny Carrier, 2300 Ch. St-Francois, Dorval, Québec, Canada

[21] Appl. No.: 602,156

[22] Filed: Oct. 26, 1990

[51] Int. Cl.[5] ..... F24F 7/08

[52] U.S. Cl. ..... 454/253; 52/134; 454/370

[58] Field of Search ..... 27/1; 52/134; 98/1, 98/33.1, 35

[56] References Cited

U.S. PATENT DOCUMENTS

| | | | |
|---|---|---|---|
| 1,012,893 | 12/1911 | Moore | 98/1 X |
| 1,048,360 | 12/1912 | Sievert | 98/1 X |
| 1,207,855 | 12/1916 | Cantwell | 98/1 X |
| 1,342,812 | 6/1920 | Hughes et al. | 52/134 X |
| 1,670,871 | 5/1928 | Webb et al. | 52/134 X |
| 1,858,722 | 5/1932 | Walker et al. | 52/134 X |
| 3,938,287 | 2/1976 | Gauchard | 52/134 |

*Primary Examiner*—Harold Joyce

*Attorney, Agent, or Firm*—Pierre Lespérance

[57] ABSTRACT

A system for promoting air circulation through the crypts of a burial monument vault in which coffins are exposed, and for treating the air evacuated therefrom by an activated charcoal-based filter panel wherein the odors from the decomposing body in the coffins will be absorbed before escape to ambient air. The system makes extensive use of the conventional existing air outlet pipes and water drainage pipes.

5 Claims, 3 Drawing Sheets

BURIAL MONUMENT VAULT AIR CIRCULATION AND FILTRATION SYSTEM

FIELD OF THE INVENTION

This invention relates to air ventilation in buildings, and more particularly, to the evacuation of stale air in burial monuments such as mausoleums.

BACKGROUND OF THE INVENTION

Burial monuments are buildings provided with a vault, which is a chamber having a plurality of compartments or crypts each for receiving the body of a dead person in a coffin. These buildings also have adjacent rooms, for access by the public wishing to pay respect to the deceased persons in the crypts.

With time, the body of the dead person decomposes within the coffin, and fluids escape outwardly therefrom into the crypt. Such organic degradation produces stale air which must be evacuated from the crypt. Known systems include a series of vertical pipes communicating with the crypts at their bottom end and endwisely opening at their top end to outside ambient air about an outdoor riser or air gate. The stale air escapes freely, without any attempt to control pollution to nearby populations. These odors in ambient air is one reason why burial or interment monuments are buildings which are relatively isolated.

With ecology including air pollution being a major concern worldwide, such cannot remain the case forever.

OBJECT OF THE INVENTION

The gist of the invention is to apply known air filtering systems to existing air circulation systems to burial monument vaults, in a very cost-effective fashion.

SUMMARY OF THE INVENTION

In accordance with the object of the invention, there is provided an air circulation and filtration system for the vault of a burial monument, comprising in combination: (a) a vault, including a plurality of closed crypts disposed laterally and in superimposed fashion relative to each other; (b) coffins, mounted in at least some of said crypts, said coffins having decomposing organic matter therein, each coffin having a volume smaller than the inner volume of the corresponding said crypt, wherein air is free to circulate around said coffin within said crypt; (c) first pipe members, opening at an air intake end to outside ambient air and at its other end into said crypts, and partly extending between said crypts, and destined to feed ambient air to said crypts; (d) second pipe members, opening at one end into said crypt and defining an air outlet end at its downstream end section opening to outside ambient air, and partly extending between said crypts, and destined to evacuate stale air from within said crypt to outside ambient air; (e) air filtration means, mounted to said downstream end section of said second pipe members, for absorbing stale odors evacuated from said crypt before escape to ambient air; and (f) air circulation means, for inducing a continuous air flow between said air intake end and said air outlet end, wherein the whole of said stale air engaging said second pipe members will be processed by said air filtration means before escape in ambient outside air.

Preferably, said air filtration means is of a type based on the activated charcoal principle.

Advantageously, each said crypt defines a floor, side walls and a top wall; said crypt defining air intake ports in operative, fluid communication with said first pipe members other end, and air outlet ports in operative, fluid communication with said second pipe members one end; there being at least one of each of these air intake and air outlet ports for each crypt and each air port being placed on the side walls of said crypt at a substantial distance from the floor of said crypt.

Profitably, liquid discharge means is mounted to said first pipe members, for evacuating organic-rich liquids seeping from the decomposing organic matter inside the coffins to an ecologically suitable collecting basin. These liquid discharge means could consist in pipe extensions, downwardly depending from said first pipe members in fluid communication therewith and extending into a gravel bed retained by a water-tight concrete base, and liquid outlet ports, made in the side walls of said crypts adjacent the crypt floor and in operative, fluid communication with said pipe extensions.

There is envisioned to add fluid-tight plugs, releasably and selectively sealing said liquid outlet ports and said air intake and outlet ports in the crypts not occupied by a coffin, wherein air circulation is prevented through these empty crypts.

DETAILED DESCRIPTION OF THE INVENTION

Figure 2:
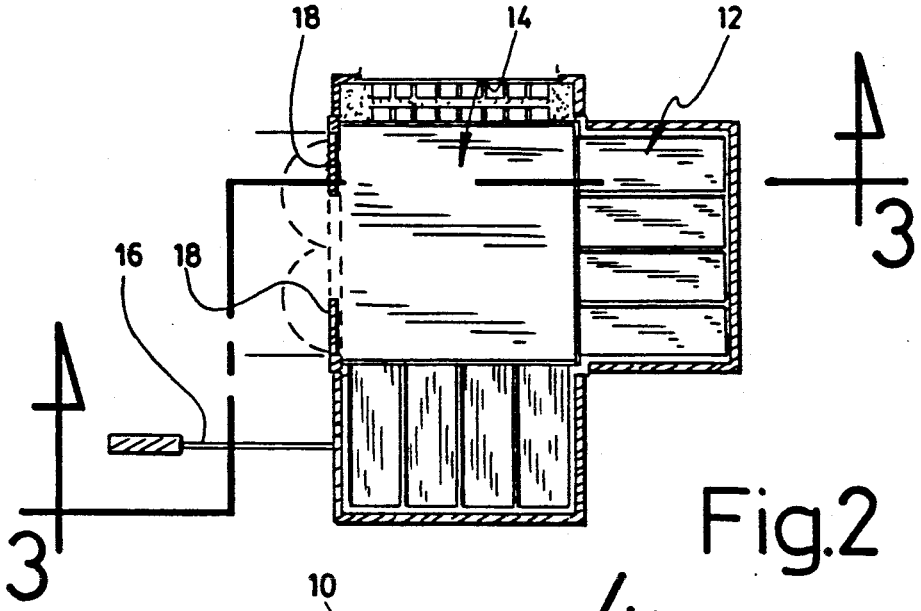
FIG. 2 is a horizontal sectional view about line 2—2 of FIG. 1.
Figure 1:
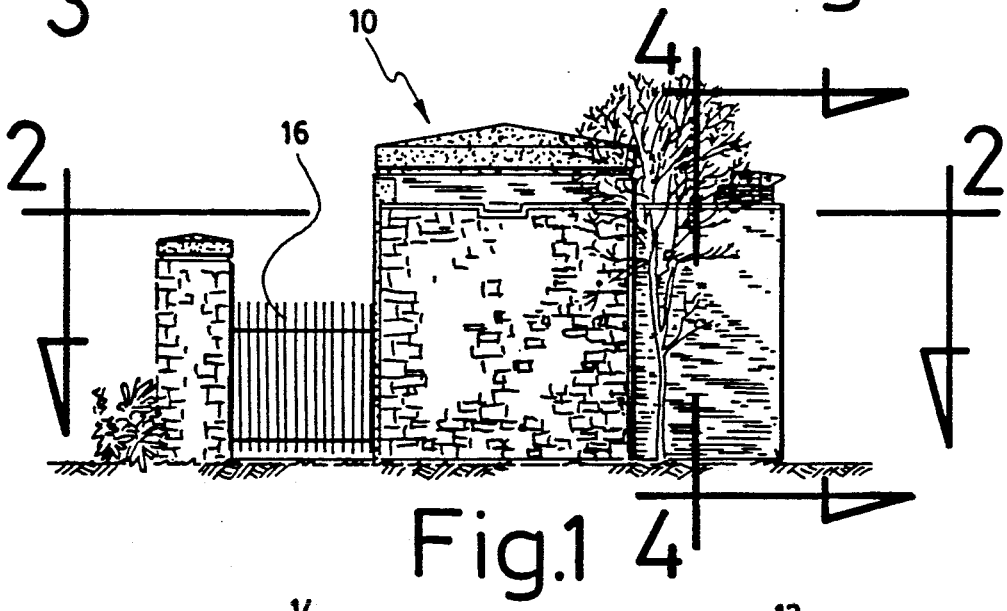
FIG. 1 is an elevational view of a burial monument.
Figure 3:
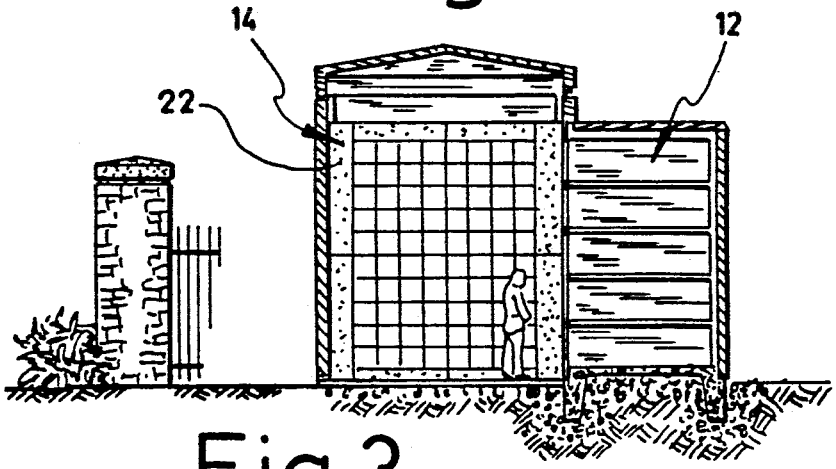
FIG. 3 is a vertical sectional view along broken line 3—3 of FIG. 2.

The burial monument 10 shown in FIGS. 1-3 conventionally consists of a large building 12 having a vault section 12, for housing coffins C, and an open room section 14, for the public wishing to enter the burial monument to pay respect to the deceased persons in the vault.

Figures 4, 5:
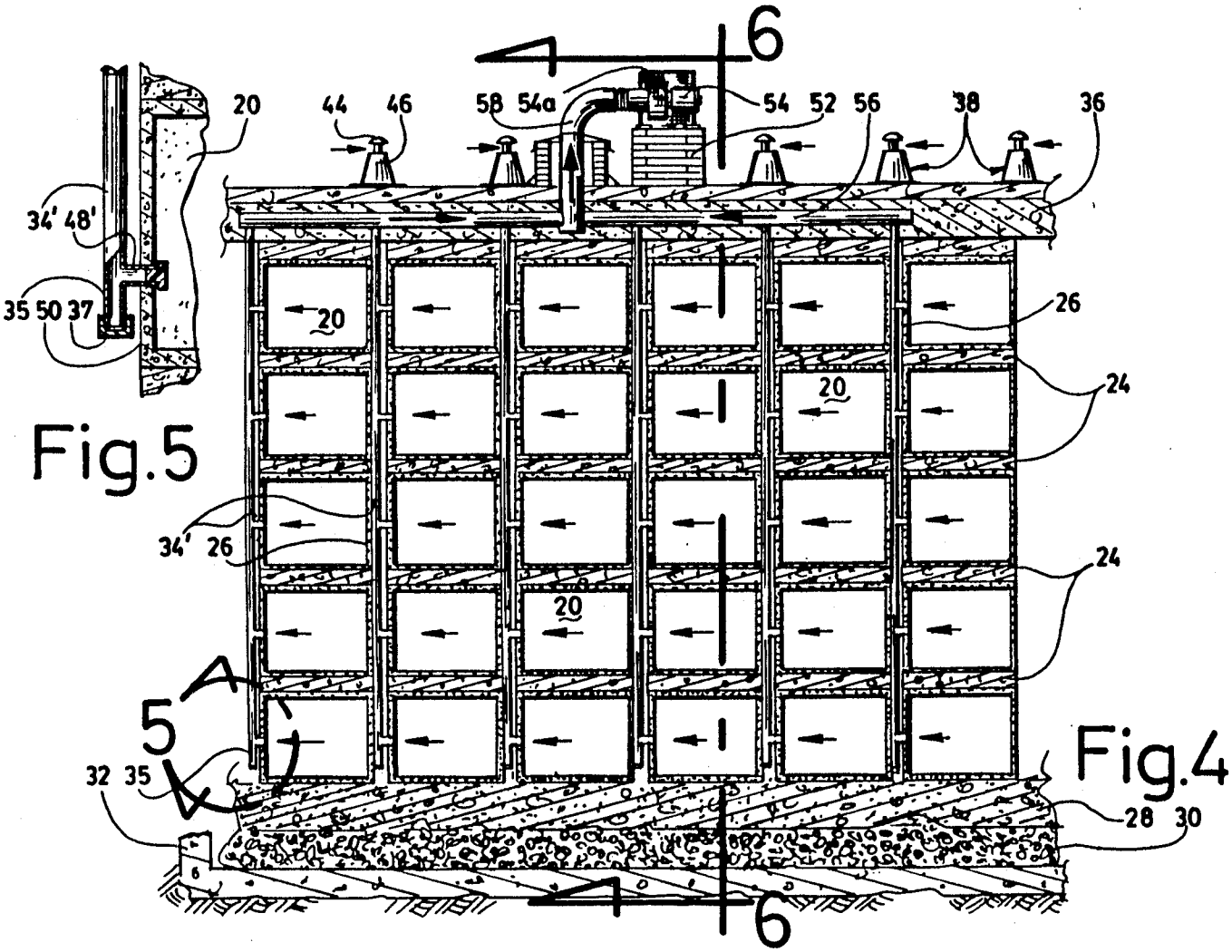
FIG. 4 is an enlarged, vertical sectional view taken along line 4—4 of FIG. 1.
FIG. 5 is an enlarged, partly broken view of the area circumscribed within area 5 of FIG. 4.

The vault section 12 is detailed in FIG. 4. The vault section 12 conventionally consists of a plurality of chambers or crypts, 20, recessed in the inner side walls 22 of the burial monument 10, for receiving the coffins containing the bodies of the dead. The crypts 20 are staggered laterally and in superimposed fashion, and are thus arranged in horizontal rows, spaced by concrete, horizontal walls 24, and in vertical columns, spaced by concrete, vertical walls 26. The bottom row of crypts 20 are supported by a thick, concrete base 28, overlying a gravel bed 30. The building 10 has a bottom, ground-engaging, waterproof foundation 32, supporting and retaining the gravel bed 30. A network of fluid pipes 34 extend thicknesswisely through the vertical walls 26, from the gravel bed 30 (FIG. 7) upwardly beyond the uppermost horizontal row of crypts 20, and through the vault concrete ceiling tiles 36 to open into an outlet member 38.

Outlet member 38 includes a sheath 40 (FIG. 7) partly embedded into the ceiling tile 38 and projecting upwardly outwardly therefrom, a mosquito net 42 covering fully the mouth 40*a* of duct 40, and a domed cover 44 supported spacedly above mouth 40*a* by conical body 46 which abuts onto the water-tight, wear-resistant covering 36*a* of the ceiling tiles 36. Sheath 40 is preferably made from lead, and cover 44, from copper.

Figures 6, 7, 8:
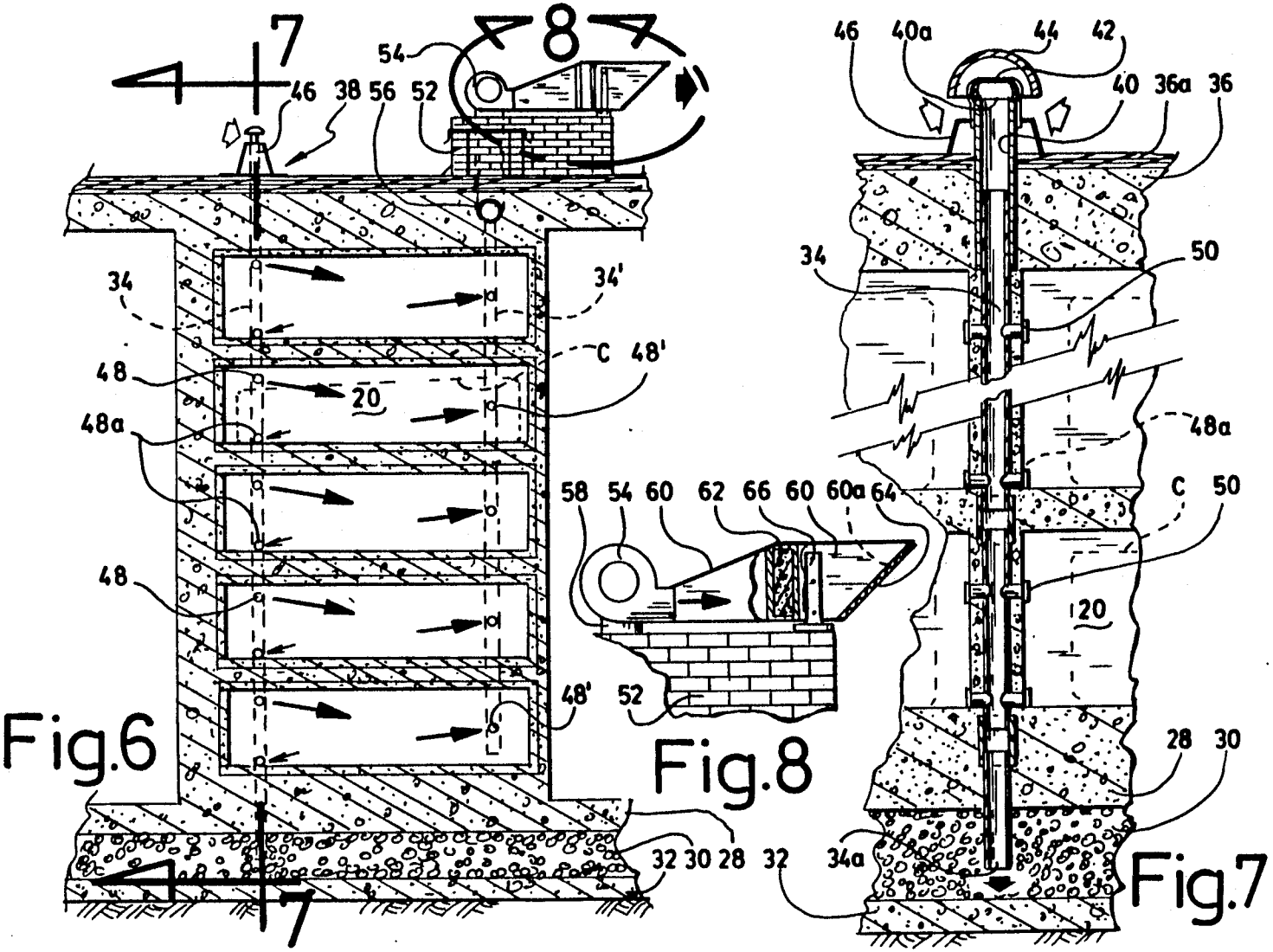
FIG. 6 is a sectional view along line 6—6 of FIG. 4.
FIG. 7 is a sectional view along line 7—7 of FIG. 6.
FIG. 8 is a slightly enlarged, partly broken view of the area circumscribed by circle 8 in FIG. 6.

Each pipe 34 has transverse pipe sections or extensions 48, at least a few of them engaging one or more side walls of each crypt 20, including at least one 48*a* about the flooring level of the crypt 20 (see FIGS. 6–7). Outlet ports 48*a* are conventional liquid outlets, for escape of the decomposing body organic-rich liquid substances seeping out from the coffin located within the crypt, through these ports 48*a*, and downwardly through the lower leg of the corresponding pipes 34 to be discharged into gravel bed 30, as suggested by the full arrow at the bottom of FIG. 7, through bottom open mouth 34*a* of each pipe 34. Accordingly, the remaining air escape ports 48 should be spaced from the flooring of crypt 20, so as to be engaged by air exclusively of liquids from the coffin, which liquids will by gravity remain on the crypt flooring.

A removable air-tight plug 50 seals each pipe sections 48 until a given crypt 20 houses a coffin C, wherein the few corresponding plugs 50 are pulled out to allow stale air to escape from the crypt, through air outlet 48 and pipes 34 and 40, and across the mosquito net 42 to be freely evacuated to the outside.

In accordance with the teachings of the invention, there is provided to the vault section an air filtering system, best shown in FIGS. 6 and 8. More specifically, to the exterior ceiling tiles 36 of the burial monument 10 is mounted a raised casing 52 anchored in position. Casing 52 supports a power operated, centrifugal ventilator 54, being connected at its intake 52*a* to some of the vertical pipes 34, at 34', via a few horizontal tubes 56, which extend horizontally through and are embedded thicknesswisely in wall 36 and which transversely merge with the last-mentioned pipes 34', at selected intervals, and a large outlet duct 58, extending vertically through wall 36 and interconnecting the tubes 56 and the ventilator air intake 52*a*. These latter vertical pipes 34' differ from the pipes 34 in that they do not open directly to the outside as in FIG. 7: sheath 40 and elements 42, 44 are thus removed, and the uppermost channel section of the pipe within wall 36, closed and sealed. Pipes 34' thus transversely merge with diametrally larger tubes 56.

Each crypt 20 must have at least one outlet pipe section 48' opening therein and fluidingly communicating with the ventilator 54 through the corresponding pipe 34', and at least one inlet pipe section 48 opening therein (two being shown in FIG. 6) and fluidingly communicating with a corresponding outlet member 38 through its pipe 34.

It can now be understood from FIG. 6 that in the present invention, element 38 becomes an air inlet member instead of a stale air outlet. Indeed, by removing all the plugs 50 from a given crypt 20, the corresponding pipes 34 and 34' communicating with this crypt will thus be in indirect fluid communication. By activating ventilator 54, a negative air pressure gradient will be applied about mouth 40*a* of air gate riser or air inlet means 38, wherein, as suggested by the multiple arrows in FIG. 6, continuous multiple air flows will be generated from ambient outside air, through mosquito net 42, downwardly into sheath 40 and pipe 34, through the crypt air intake port(s) 48, through crypt itself 20 and around the side and top walls of coffin C, to escape through the crypt air outlet port(s) 48', upwardly along pipes 34', 56 and 58 to the ventilator 54 for air ejection through an enlarged, extended nozzle 60.

Accordingly with the heart of the invention, nozzle 60 is provided with a filter means 62, about a diametrally large section thereof. Filter means 62 is preferably a filter panel of the activated charcoal bed type. The whole of the stale air from the decomposing human body within the crypt 20, must be directed by the nozzle 60 to pass through filter 62, to thus be processed, and the odors, adsorbed by the activated charcoal, so that the air finally being evacuated at the nozzle outlet 60*a* will be odorless.

Preferably, a metallic grate 64 is provided about nozzle mouth 60*a*, to prevent ambient air contaminant from clogging filter 62 while not hampering free air flow therethrough. Elongated nozzle 60 may be supported by bracket 66 over brick support casing 52.

Coffin C is smaller than the inner volume of each crypt 20, so that air may freely circulate therearound. As suggested in FIGS. 6 and 7, the same pipe 34 feeding air into a crypt 20 through air intake ports 48 (upper pipe section) will also be used for receiving organic-rich liquid substances from the crypt passing through floor level liquid outlet port 48*a*, and to discharge same in the gravel bed 30 (lower pipe section). Clearly, fresh air inflow into the crypt 20 through air intake ports 48 can be effected concurrently with outflow of organic-rich liquid substance through liquid outlet ports 48. On the other hand, the bottom end 35 of the modified vertical pipes 34' should extend downwardly short of the concrete base 28, and will be sealingly closed by a sealing cap 37, as illustrated in FIGS. 4 and 5.

It is to be understood that although the inventor has found particularly cost-efficient to use the existing vertical pipes of the standard air circulation system of burial monument vaults, including some of the existing conventional vault vertical pipes 34 as the air feeders for the main tubes 56, these pipes 34 being slightly structurally modified as disclosed above for the stated purpose, it is to be considered well within the scope of the present invention that the modified pipes 34' be replaced by additional vertical pipes, not shown, including their transverse pipe sections, so as to be similar to elements 34', 48', again in view of evacuation of stale air through filter means 62.

All the piping, ducts, tubes, and so on coming in contact with the organic-rich fluids from the crypt should be made from a fluid-resistant, rigid material, preferably a plastic material such as polyvinyl chloride (PVC).

I claim:

1. A vault for a burial monument, comprising:

(a) a plurality of closed crypts, staggered in superimposed fashion, each crypt defining an inner hollow chamber for receiving a coffin in which stale air generating organic material decomposes;

(b) a building, enclosing said crypts and defining a top portion and a bottom ground embedded portion, said building top portion opening to fresh atmospheric air;

(c) a first pipe member, vertically extending through said building and defining an upstream, atmospheric air, first intake, mounted to said building top portion, and a number of downstream, spaced, first air outlets, mounted to selected said crypts;

(d) a second first pipe member, vertically extending through said building and defining a number of upstream, spaced, stale air, second intakes, mounted to said crypt, and a downstream, second stale air outlet, mounted to said building top portion; an air flow network defined starting from said first fresh air intake, through said first pipe members crypt chamber, and said second pipe member to said second stale air outlet; further including:

(e) forced air, suction-type circulation means, mounted about said second air outlet for generating and sustaining continuous forced air flow through said airflow network; and (f) air filtration means, mounted to said second air outlet for neutralizing staleness of said stale air before escape to atmospheric air.

2. An air circulation and filtration system as defined in claim 1, wherein said air filtration means is of a type based on the activated charcoal principle.

3. An air circulation and filtration system as defined in claim 1, further including liquid discharge means, for evacuating organic-rich liquids seeping from the decomposing organic matter inside the coffins to an ecologically suitable collecting basin.

4. An air circulation and filtration system as defined in claim 3, wherein said liquid discharge means consists in a first pipe member extension, extending through said building bottom portion and downwardly depending from said first pipe member in fluid communication therewith and extending into a gravel bed retained by a water-tight concrete base, and liquid outlet ports, made in the side walls of said crypts adjacent the crypt floor and in operative, fluid communication with said pipe extensions.

5. An air circulation and filtration system as defined in claim 4, further including fluid tight plugs, releasably and selectively sealing said liquid outlet ports and said first air outlets and second air intakes in the crypts not occupied by a coffin, wherein air circulation is prevented through these empty crypts.

* * * * *